US012037903B2

(12) United States Patent
Bischoff

(10) Patent No.: US 12,037,903 B2
(45) Date of Patent: Jul. 16, 2024

(54) DRILL ASSEMBLY AND METHOD OF USING SAME

(71) Applicant: Nicolas Jacobus Bischoff, Kleinmond (ZA)

(72) Inventor: Nicolas Jacobus Bischoff, Kleinmond (ZA)

(73) Assignee: ORYC DRILL MANUFACTURING (PTY) LTD, Onrus (ZA)

( * ) Notice: Subject to any disclaimer, the term of this patent is extended or adjusted under 35 U.S.C. 154(b) by 0 days.

(21) Appl. No.: 17/761,338

(22) PCT Filed: Sep. 16, 2020

(86) PCT No.: PCT/IB2020/058600
§ 371 (c)(1),
(2) Date: Mar. 17, 2022

(87) PCT Pub. No.: WO2021/053526
PCT Pub. Date: Mar. 25, 2021

(65) Prior Publication Data

US 2022/0349259 A1 Nov. 3, 2022

(30) Foreign Application Priority Data

Sep. 17, 2019 (ZA) ..... 2019/06123

(51) Int. Cl.
*E21B 7/04* (2006.01)
*E21B 10/26* (2006.01)
(Continued)

(52) U.S. Cl.
CPC ..... *E21B 7/046* (2013.01); *E21B 10/26* (2013.01); *E21B 10/43* (2013.01); *E21B 10/633* (2013.01); *E21B 17/0465* (2020.05)

(58) Field of Classification Search
CPC ..... E21B 7/046; E21B 17/0465; E21B 10/26; E21B 10/43; E21B 10/633; E21B 7/064; E21B 7/06; E21B 7/003
See application file for complete search history.

(56) References Cited

U.S. PATENT DOCUMENTS 5,253,721 A 10/1993 Lee
5,392,868 A * 2/1995 Deken ..... E21B 10/62 175/62

(Continued)

FOREIGN PATENT DOCUMENTS

EP 0857853 8/1998
WO WO9733065 9/1997

*Primary Examiner* — Caroline N Butcher
(74) *Attorney, Agent, or Firm* — LAW OFFICES OF STEVEN W. WEINRIEB

(57) ABSTRACT

A drill assembly comprises a drill shoe body has a substantially triangular cross-sectional configuration, an upper surface portion of the drill shoe body comprises forward and rearward sections which are disposed at a predetermined angle with respect to each other, oppositely disposed lateral sides of the drill shoe body taper laterally outwardly from the front end of the drill shoe body toward an intermediate transverse plane, while oppositely disposed lateral sides of the drill shoe body taper laterally inwardly from the transverse plane toward the rear end portion of the drill shoe body. Multiple, spaced apart drill bits are disposed upon a front end of said drill shoe body, oppositely disposed lateral sides of the drill shoe body, and oppositely disposed flank portions of the drill shoe body so as to assist the drill shoe body in acting as both a pilot bore drilling tool and as a reaming tool in connection with a drilled bore.

17 Claims, 3 Drawing Sheets

(51) Int. Cl.

| | |
|---|---|
| ***E21B 10/43*** | (2006.01) |
| ***E21B 10/633*** | (2006.01) |
| ***E21B 17/046*** | (2006.01) |

(56) References Cited

U.S. PATENT DOCUMENTS

| | | | | |
|---|---|---|---|---|
| 2003/0150650 | A1* | 8/2003 | Sved | E21B 7/046<br>175/398 |
| 2017/0241206 | A1* | 8/2017 | Webb | E21B 7/064 |

* cited by examiner

DRILL ASSEMBLY AND METHOD OF USING SAME

FIELD OF THE INVENTION

This invention relates to underground operations and equipment for working through stone and stone-like materials, cement, sand and clay. More particularly, the invention relates to a drill assembly adapted for drilling elongate relatively shallow to deep horizontal and vertical holes in underground areas where the underground constituents are hard and difficult to break and structures above ground surface need to remain intact. The invention also extends to a method of using such drill assembly in underground drilling operations and to a method of manufacturing same.

BACKGROUND TO THE INVENTION

Subterranean land mass does not always comprise soft and easily penetrable soil or materials. Quite often hard rocky areas are encountered which result in breakage of conventional underground drilling equipment. Despite improvements over the years in respect of drill shoes, these improved shoes remain expensive and often incapable of being used in areas where relatively shallow drilling or so-called horizontal directional drilling is required. Such areas include through-passages extending below tar roads, underneath railway and road tunnels, bridges, rivers and through mountains.

Ubiquitous techniques of constructing relatively shallow through-passages, involve utilization of a drill assembly to drill a relatively shallow-to-deep throughbore using a string of drill pipe having a drill bit on a drill shoe attached to a leading end of the drill string. As the drill string is advanced, initially at an oblique angle but later horizontally, into the ground, the drill shoe encounters different rock formations, some of which may be unstable and cause breakage.

The drill string is commonly advanced into the ground by way of compressed air utilizing compressors which further adds to the overall cost of drilling.

Another disadvantage of conventional horizontal directional drilling machine is that it requires use of a reamer after the desired length of throughbore has been obtained while extending, for example, underneath a road. The reamer is detachably mounted to the drill head after initial drilling and pulled back through the throughbore, thus reaming out the throughbore to a larger diameter.

It will be appreciated that the drill assembly of the present invention addresses, at least in part, drawbacks associated with commonly available drilling assemblies and that it is adapted to provide safe passages for utility lines for fibre optic cables, telephone, gas, water, or electricity in areas where conventional drilling assemblies fail, or are too expensive to operate.

It is a further object of the invention to introduce a simplified drill assembly and method of use in a subterranean environment where structures above ground surface need to remain intact.

SUMMARY OF THE INVENTION

In broad terms, this invention provides a drill assembly for use in mining or trenchless subterranean boring, the assembly comprising: a drill shoe having spaced apart drill bits disposed on opposing sides and flanks of a body of the drill shoe to facilitate acting as both pilot bore drilling tool and as reaming tool; a drill head demountably mounted to the drill shoe and in communication with directional guidance means remote from the drill shoe and apt to guide movement of the drill head at a slanted angle, vertically and horizontally into the ground; a string of connectable drill rods, having a trailing end and a leading end when connected, and through which a drilling solution can be pumped towards a solution exit provided in the drill shoe; a coupling for linking the leading end to said drill head; and a connector for connecting the trailing end to a D-shackle and swivel of a vehicle, being typically, but not necessarily, a drilling machine.

Moreover, a drill shoe is provided with a shape and configuration designed to act as both pilot bore drilling tool and as reaming tool.

In an embodiment, the drill shoe may comprise a body being symmetrical about a longitudinal axis. The body may comprise an anterior portion in which a recess is defined for releasably locating the drill head and a posterior portion on which multiple bits are releasably affixed or, alternatively, integrally formed with the drill shoe and of uniform construction therewith. The bits may be equidistantly spaced apart. The recess may comprise multiple spaced apart apertures for locating fasteners.

In an embodiment, the posterior portion may be divided into a generally planar front section and a generally planar rear section, which sections join at a central part of the body having the greatest width and depth. Planes of the rear section and front section may form a reflex angle between them of between about 190° and about 230°.

Both the rear and front sections may comprise flanks that each define a chamfered surface slanting away from the respective planes of the rear and front section at an acute angle of between 20° to 80° and which become tapered as they approach respective front and rear ends of the drill shoe.

Multiple apertures may be provided in the rear section for releasably accommodating fasteners for fitting corresponding holes provided in the drill head.

Generally planar lateral sides may be provided for the shoe, which sides are typically disposed directly opposite each other on lateral sides of the longitudinal axis and which extend generally at right angles to the respective generally planar rear and front sections.

Beveled fringes may be provided contiguous with the respective generally planar sides terminating against a flush surface of the anterior portion. The fringes may be slanted away from the generally planar lateral sides.

In an embodiment, the flanks, fringes and sides are all angled away from the central part of the body, which central part has the greatest width and depth, as the flanks, fringes and sides extend towards the respective rear and front ends. Four flanks, four fringes and four sides are provided in an embodiment of the invention.

In an embodiment, the drill head may comprise one or more channels in communication with the drill pipe string and through which a drilling solution can be pumped so as to exit at one or more outlets proximate the recess.

The invention also extends to a method for trenchless subterranean boring and reaming, the method comprising:

- providing a drill assembly as described hereinabove;
- mounting a drill shoe to a drill head;
- linking a leading end of a string of drill pipe, via a coupling, to said drill head;
- via a connector, connecting a trailing end of said string of drill pipe to a power D-shackle and swivel of a vehicle;
- actuating rotation of said D-shackle and swivel to rotate the string of drill pipe with the drill head and rill shoe;

guiding the drill head by way of directional guidance means, remote from the drill head, to move at a slanted angle, vertically and horizontally into the ground whilst pumping a drilling solution through the drill assembly.

The invention further extends to a method of manufacturing a drill shoe, comprising the steps of:

providing a mass of metal alloy suitable for subterranean drilling;

metal working said mass to form an oblong drill shoe body symmetrical about a longitudinal axis and having a central cross-sectional part with a width and depth greater than front and rear ends thereof and defining multiple linear planes on said body sloping towards said respective front and rear ends as well as a recess for releasably locating a complementary shaped drill head through which a drill solution can be pumped.

BRIEF DESCRIPTION OF THE DRAWINGS

The invention is now described by way of example with reference to the accompanying non-limiting diagrammatic drawings. In the drawings.

DETAILED DESCRIPTION OF THE DRAWINGS

Figure 1:
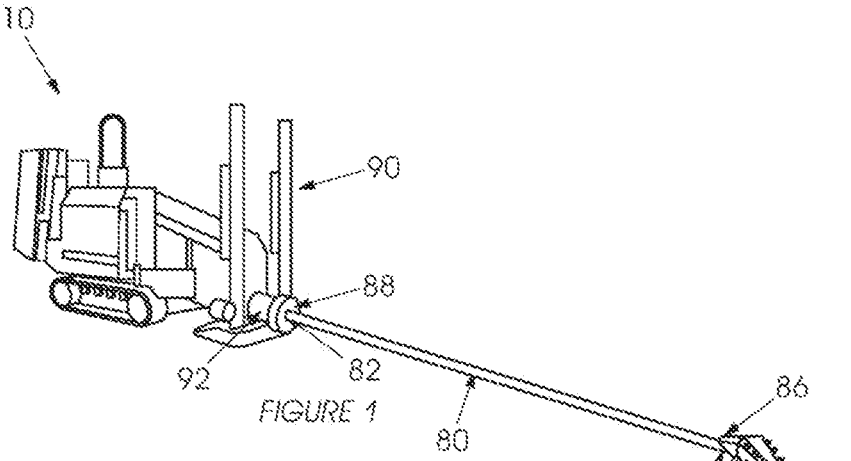
FIG. 1 shows an isometric view of a drill assembly for trenchless subterranean boring, in accordance with an embodiment of the invention.

In the Figures, reference numeral 10 refers to a drill assembly for trenchless subterranean boring in accordance with the invention.

Figure 2:
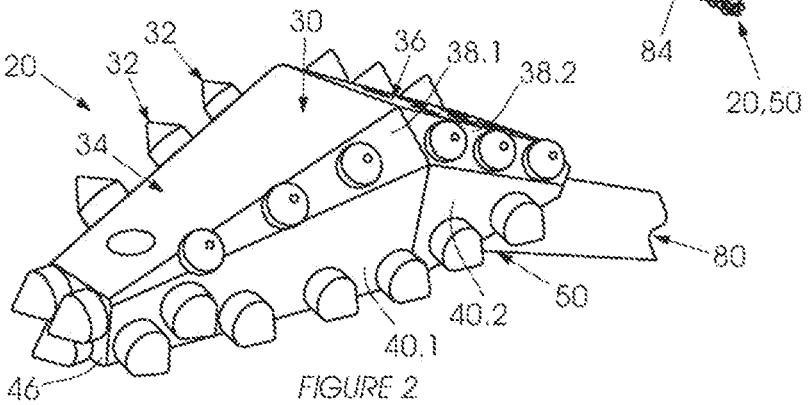
FIG. 2 shows a top right front isometric view of a drill shoe connected to a drill head of the drilling assembly of FIG. 1.

Similarly, reference numeral 20, as best shown in FIG. 2, refers to a drill shoe for use with the drill assembly 10 in subterranean boring in accordance with the invention.

As depicted in FIGS. 2, 3, 4, and 5, the drill shoe 20 is releasably mountable to a drill head 50 (FIG. 3) by way of bolts (not shown) extending through apertures 52.

Components of the drill assembly 10 include the drill shoe 20 and drill head 50 together with a directional guidance means (although not shown, typically of the joy-stick type) remotely located in relation to the drill shoe and apt to guide movement of the drill head 50 at either a slanted angle, vertically and/or horizontally into the ground. Further components include a string of drill rods or pipes 80, a suitable connector 88 and coupling 86, and a drilling machine 90 with a rotational power D-shackle and swivel 92, as best shown in FIG. 1.

Figure 3:
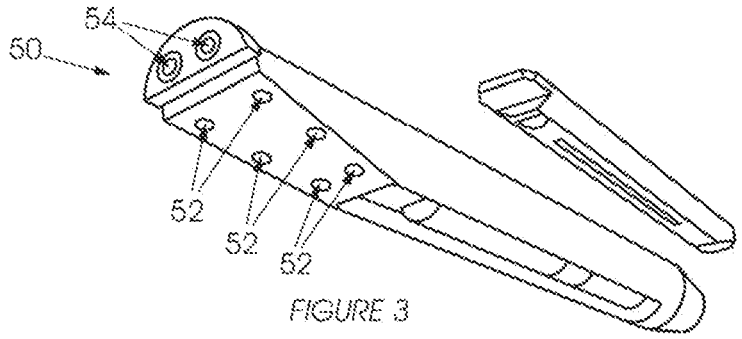
FIG. 3 shows a bottom right front isometric view of a drill head of the drill assembly of FIG. 1.

The drill head 50 of FIG. 3 is preferably demountably mounted to the drill shoe 20, in communication with directional guidance means for guiding movement of the drill head 50 initially at a slanted angle as it enters the ground, vertically thereafter to reach a suitable drilling depth, and finally horizontally to traverse, for example, a tar or paved road without damaging same there below.

As shown in the drawings, the string of drill rods 80 has a trailing end 82 and a leading end 84. The connector 88 ensures operative connection between the trailing end 82 and a power take-off shaft connected to the rotational power D-shackle and swivel 92, while the coupling 86 ensures operative linkage between the leading end 84 to the drill head 50.

The connected pipes 80 are hollow to allow a drilling solution to be pumped therethrough. The pipes 80 are also operatively in fluid communication with the drill head 50.

The unique shape of the drill shoe body 20, as best shown in FIGS. 2, 4, 5, 6 and 7 of the drawings, wherein the shape thereof is shown to deviate from square, rectangular, and triangular forms by elongation along a longitudinal and crosswise dimension, ensures that the drill assembly 10 can act as both pilot bore drilling tool and as reaming tool all at once.

Figure 4:
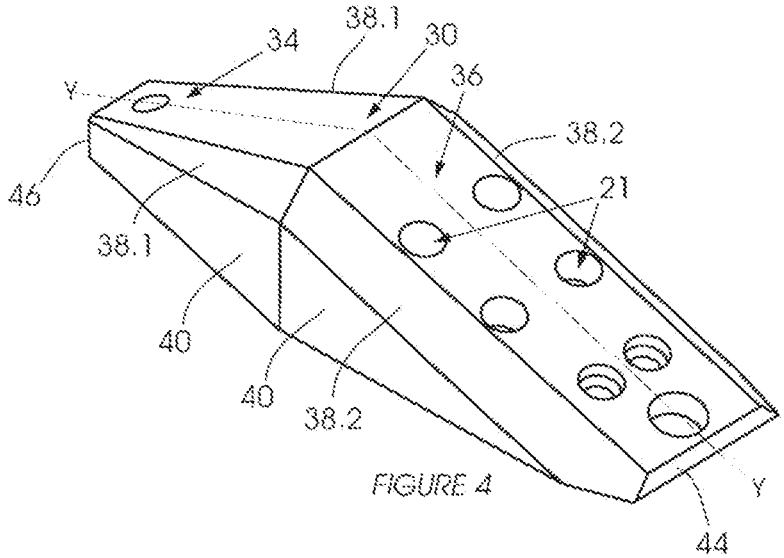
FIG. 4 shows a left front isometric view of a posterior portion of the drill shoe of FIG. 2, without bits connected thereto
Figure 5:
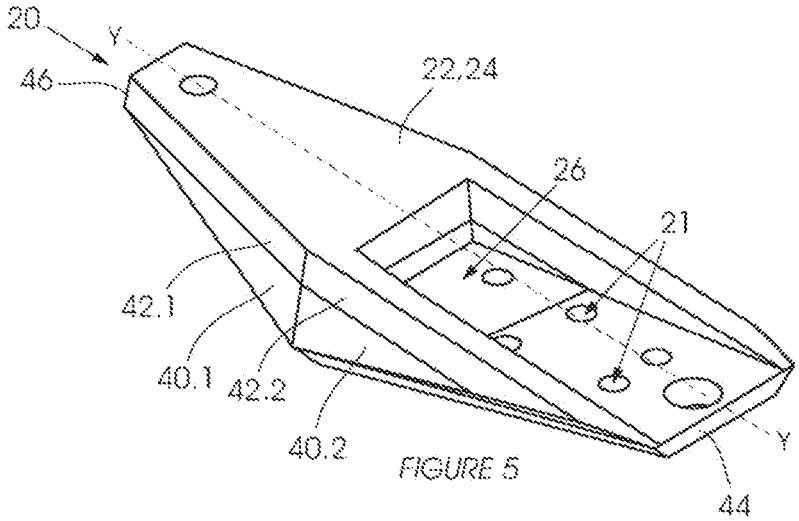
FIG. 5 shows a left front isometric view of an anterior portion of the drill shoe of FIG. 2, without bits connected thereto.
Figure 6:
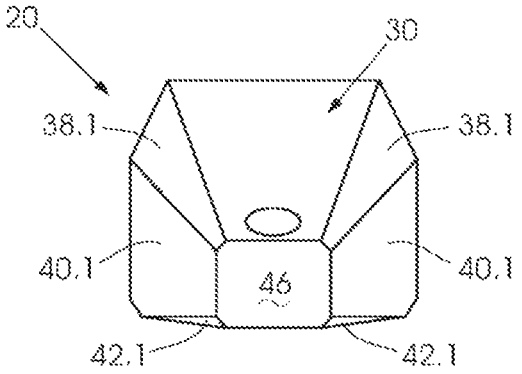
FIG. 6 shows a front isometric view of the drill shoe of FIG. 2, without bits connected thereto.
Figure 7:
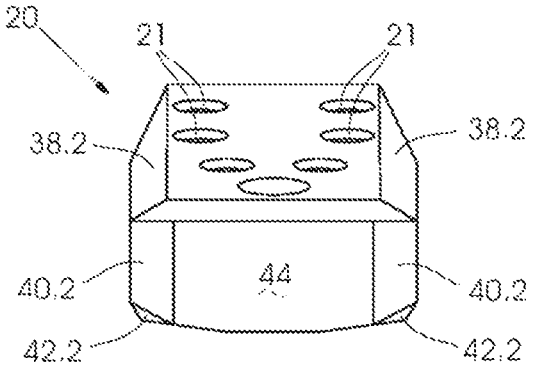
FIG. 7 shows a rear isometric view of the drill shoe of FIG. 2, without bits connected thereto.

Referring to FIGS. 4 and 5, the drill shoe body 20 is symmetrical about a longitudinal axis y-y. The body 20, as best shown in FIG. 5, includes an anterior portion 22 having a generally flush surface 24 in which a recess 26 is defined for releasably locating the drill head 50. The recess 26, as shown, has spaced apart apertures 21 for locating fasteners (not shown) for fastening the drill head 50 to the recess 26.

The drill shoe body 20 also defines a posterior portion 30 on which multiple bits 32, as best shown in FIG. 2, are releasably affixed. It is envisaged that in other embodiments of this invention, the bits 32 are integrally formed with the drill shoe 20 and of uniform construction therewith. The bits 32 are typically, but not necessarily equidistantly spaced apart on the posterior portion 30. The bits 32 are identically shaped to one another and defines a cylindrical base that tapers towards a pointed tip. The bits 32 are typically manufactured from air-hardened steel metallurgically bonded to tungsten carbide particles. This increases drill shoe durability during use in hard rock conditions.

As visible from FIG. 4, the posterior portion 30 is divided into a generally planar front section 34 and a generally planar rear section 36, which sections meet at a central part 36 of the body 20, which central part has the greatest width and depth compared to the rest of the body 20. This central part 36 appears as a broadened waist on the body 20. Planes of the rear section and front section 36,34 form a reflex angle between them of between 190° and 230°.

Both the rear and front sections 36,34 further define flanks 38.1; 38.2 that slant away from the respective planes of the rear and front section 36,34 at an acute angle of between 20° to 80° and which become tapered as they approach respective front and rear ends of the drill shoe body 20.

Multiple apertures 21 is provided in the rear section 36 for releasably accommodating fasteners such as bolts for fitting corresponding holes 52 provided in the drill head 50.

Still referring to FIG. 4, a pair of generally planar lateral sides 40.1; and a second pair of generally planar lateral sides 40.2 are formed on the shoe body 20. Each pair 40.1; 40.2 is disposed directly opposite each other on lateral sides of the longitudinal axis Y-Y. The sides 40 extend generally at right angles to planes of the respective rear and front sections 36,34.

Two pairs of fringes 42.1; 42.2, contiguous with the respective generally planar sides 40.1; 40.2, terminate against a flush surface 24 of the anterior portion 22. The fringes 42 are formed to slant away from the generally planar lateral sides 40 in a direction towards the longitudinal axis Y-Y.

As shown in the drawings, two opposing pairs of flanks 38.1; 38.2, two opposing pairs fringes 42.1; 42.2 and two opposing pairs lateral sides 40.1; 40.2 are shaped on the body 20. The flanks 38, fringes 42 and sides 40 are all angled away from the central part or broadened waist 36 of the body 20 as they extend towards the respective rear and front ends 44,46, as best shown in FIGS. 4 and 5.

Referring to FIG. 3, the drill head 50 consists of two channels 54 in communication with the drill pipe string 80 and through which a drilling solution can be pumped so as to exit at one or more outlets proximate the recess 26.

In use, the drill assembly 10 as described herein, with its respective components are acquired. Thereafter, by utilisation of suitable bolts extendable through apertures 21 and 52, the drill head 50 is fastened to fit the recess 26 of the drill shoe body 20. The fasteners are preferably suitably torqued with complementary nuts (not shown).

Next, a leading end 84 of a string of drill rods 80, is coupled via a coupling 86 to the drill head 50 at its rear side. Then, a trailing end 82 of the string of drill rods 80 is connected via a connector 88 to a rotational power take-off shaft 92 of the vehicle 90. Actuation of rotation of the power take-off shaft 92 follows, which in turn permits the string of drill rods 80 to rotate with the drill head 50 and drill shoe 20 attached thereto.

Finally, the drill head 50 is guided by way of directional guidance means (not shown), remote from the drill head, to move at a slanted angle, vertically and eventually horizontally into the ground whilst pumping a drilling solution through the shoe 20.

While preferred embodiments of the invention are shown and described, it will be understood that it is not intended to limit the extent of the invention, but rather it is intended to cover all modifications and alternate methods, including: methods, for using the drill assembly 10 falling within the spirit and the scope of the invention.

The applicant believes that the drill assembly 10 of the present invention, at least in part, addresses shortcomings in conventional trenchless drilling units in that it provides a neat, sturdy, functional and cost-effective alternative which has fewer components and are easier to manufacture compared to ubiquitous drilling units and allows for reaming and drilling at the same time.

The invention for which patent protection is sought is defined in the set of claims that follows.

The invention claimed is:

1. A drill assembly for use in trenchless subterranean ground boring, comprising:

a drill shoe comprising a body defined along a longitudinal axis and having a substantially triangular cross-sectional configuration, as taken along said longitudinal axis, such that an upper surface portion of said drill shoe body comprises forward and rearward sections which are disposed at a predetermined angle with respect to each other and which meet at a vertex at a transverse plane located at an axial location between a front end of said drill shoe body and a rear end of said drill shoe body, a lower surface portion of said drill shoe body is planar, a recess is defined within said lower surface portion of said drill shoe body such that said recess is inclined upwardly from a rear end portion of said lower planar surface portion of said drill shoe body toward said vertex of said upper surface portion of said drill shoe body, oppositely disposed lateral sides of said drill shoe body taper laterally outwardly, with respect to said longitudinal axis, from said front end of said drill shoe body toward said transverse plane, oppositely disposed lateral sides of said drill shoe body taper laterally inwardly, with respect to said longitudinal axis, from said transverse plane toward said rear end portion of said drill shoe body, and multiple, spaced apart drill bits are disposed upon a front end of said drill shoe body, oppositely disposed lateral sides of said drill shoe body, and oppositely disposed flank portions of said drill shoe body so as to assist said drill shoe body in acting as both a pilot bore drilling tool and as a reaming tool in connection with a drilled bore;

a directional guidance control mounted upon said drill assembly at a location remote from said drill shoe body and adapted to guide movements of said drill shoe body along slanted, vertical, and horizontal directions into the ground;

a drill head detachably mounted upon said drill shoe body; and at least one pair of drill pipes extending along a second longitudinal axis, operatively connected at a first end thereof to said directional guidance control, operatively connected at a second end thereof to said drill head, and having internal conduits through which a drilling solution can be pumped from said drill assembly toward solution outlets provided within said drill head;

wherein said drill head is detachably mounted within said inclined recess of said drill shoe body such that said forward section of said drill shoe body is automatically disposed at a downwardly inclined angle with respect to said second longitudinal axis of said at least one pair of drill pipes, when said drill head is mounted within said inclined recess of said drill shoe body, so as to facilitate said drilling and reaming of the drilled bores within the ground by said multiple spaced apart drill bits mounted upon said drill shoe body.

2. The drill assembly of claim 1, wherein said drilling assembly is operatively connected to a drilling machine.

3. The drill assembly of claim 1, wherein the drill shoe comprises a body which is symmetrical about said longitudinal axis.

4. The drill assembly of claim 1, wherein said spaced apart drill bits, disposed upon said oppositely disposed lateral sides of said drill shoe body and said oppositely disposed flanks of said drill shoe body, form a linear array of drill bits that are equidistantly spaced apart from each other.

5. The drill assembly of claim 4, wherein said drill bits, disposed upon said oppositely disposed lateral sides of said drill shoe body, form said linear array of drill bits that are equidistantly spaced apart from each other except for one drill bit which is irregularly disposed relative to said linear array of drill bits.

6. The drill assembly of claim 5, wherein said one drill bit is disposed adjacent to said front end of said drill shoe body so as to be interposed between first and second drill bits disposed upon said oppositely disposed lateral sides of said drill shoe body.

7. The drill assembly of claim 1, wherein multiple drill bits extend away from said front end of said drill shoe body with respective longitudinal axes of each drill bit extending parallel to said longitudinal axis of said drill shoe body.

8. The drill assembly of claim 1, wherein the recess comprises multiple spaced apart apertures for locating fasteners.

9. The drill assembly of claim 1, wherein:

said upper surface portion of said drill shoe body is divided into a generally planar front section and a generally planar rear section; and said generally planar front and rear sections are joined at a central part of said drill shoe body which has a width and depth greater than the remainder of said drill shoe body.

10. The drill assembly of claim 9, wherein planes of said generally planar rear and front sections form a reflex angle between them of between 190° and 230°.

11. The drill assembly of claim 10, wherein both said generally planar rear and front sections comprise flanks that slant away from respective planes of said generally planar rear and front sections at an acute angle of between 20° to 80° and which become tapered as they approach said front end of said drill shoe body.

12. The drill assembly of claim 11, wherein multiple apertures are provided within said rear section of said drill shoe body for releasably accommodating fasteners for fitting corresponding holes provided within said drill head.

13. The drill assembly of claim 12, wherein said oppositely disposed lateral sides of said drill shoe body are generally planar, are disposed directly opposite each other upon opposite sides of said longitudinal axis, and extend generally at right angles to said generally planar rear and front sections of said drill shoe body.

14. The drill assembly of claim 13, wherein fringes are provided upon said drill shoe body so as to be respectively contiguous with said oppositely disposed, generally planar lateral sides of said drill shoe body, and wherein each fringe terminates against an edge of said lower surface portion of said drill shoe body.

15. The drill assembly of claim 14, wherein said fringes slant away from said generally planar lateral sides of said drill shoe body.

16. The drill assembly of claim 14, wherein said flanks, said fringes, and said lateral sides of said drill shoe body are all angled away from a central part of said drill shoe body, which central part defines the greatest width and depth of said drill shoe body as said flanks, said fringes, and said lateral sides of said drill shoe body extend towards said rear and front ends of said drill shoe body.

17. The drill assembly of claim 1, wherein said drill head comprises at least one channel in communication with a drill rod string through which a drilling solution can be pumped to exit at multiple outlets proximate said recess.

* * * * *